US005709461A

United States Patent [19]

Michl et al.

[11] Patent Number: 5,709,461

[45] Date of Patent: Jan. 20, 1998

[54] ELECTRICAL CONCERTINA-TYPE LAMP

[76] Inventors: Oliver Michl; Patrick Frieling, both of Längenau 35, 95100 Selb, Germany

[21] Appl. No.: 622,303

[22] Filed: Mar. 27, 1996

[30] Foreign Application Priority Data

Mar. 30, 1995 [DE] Germany ..... 195 11 839.1

[51] Int. Cl.[6] ..... F21V 21/26

[52] U.S. Cl. ..... 362/239; 362/250; 362/418; 362/427

[58] Field of Search ..... 362/232, 238, 362/239, 249, 250, 413, 419, 429, 252, 404, 418, 427, 430

[56] References Cited

U.S. PATENT DOCUMENTS

| | | | |
|---|---|---|---|
| 2,210,537 | 8/1940 | Huebner | 362/232 |
| 2,276,223 | 3/1942 | Manders | 362/232 |
| 3,641,333 | 2/1972 | Gendron | 362/108 |
| 5,018,055 | 5/1991 | Wu | 362/238 |

FOREIGN PATENT DOCUMENTS

| | | | |
|---|---|---|---|
| 386080 | 4/1908 | France | 362/252 |
| 475399 | 2/1915 | France | 362/252 |
| 585925 | 9/1933 | Germany | 362/252 |
| 9303347.8 | 9/1993 | Germany . | |
| 9312723.5 | 1/1994 | Germany . | |

*Primary Examiner*—Alan Cariaso

*Attorney, Agent, or Firm*—Bell Seltzer Intellectual Property Law Group of Alston & Bird LLP

[57] ABSTRACT

An electrical concertina-type lamp comprises two identical sliding lattices (2, 3) which extend parallel to each other and are made of electrically conductive material, each being connected to one of the poles of a low voltage power source and their respective joints (5, 6) being located opposite each other, at least two opposed joints (5, 6) being provided with tubular bulb terminals (10) and interconnected by small tubular incandescent bulbs (11).

10 Claims, 2 Drawing Sheets

ELECTRICAL CONCERTINA-TYPE LAMP

FIELD OF THE INVENTION

The instant invention relates to an electrical concertina-type lamp.

BACKGROUND OF THE INVENTION

Electrical lamps are known which have an illuminating or lighting means fastened to one end of a sliding lattice or concertina-type structure whose other end is stationary or, if desired, pivotably supported. The position of the illuminating means in the room can be altered by pushing together or extending and swinging the sliding lattice. The illuminating means is connected to a power source by means of a cable which is passed along the lattice structure.

Likewise known are concertina-type lamps which are designed as suspended lamps to extended horizontally. In this case an illuminating means each is fastened to a plurality of members of a horizontally positioned sliding lattice, the plurality of illuminating means forming a compact arrangement when the sliding lattice is pushed together and a straight row when the sliding lattice is extended. In this manner uniform lighting can be achieved, for instance, of an extensible table.

These electrical concertina-type lamps are disadvantageous in that either the connecting cables for all the illuminating means must be passed along the outside of the sliding lattice, causing severe detraction from the esthetic appearance, or that the members of the lattice structure must be made hollow so that the cables may be laid in the interior. True, the latter solution provides a more pleasant article, yet its manufacture is more complicated and, therefore, expensive.

SUMMARY OF THE INVENTION

This is where the invention is to come in and provide an improved telescopic electrical concertina-type lamp with but a few visible electrical connecting members and which can be manufactured at lower cost.

That is achieved, according to the invention, with an electrical concertina-type lamp comprising two identical sliding lattices which extend parallel to each other and are made of electrically conductive material, each being connected to one of the poles of a low voltage power source and their respective joints being located opposite each other, at least two opposed joints being provided with tubular bulb terminals and interconnected by small tubular incandescent bulbs.

An electrical concertina-type lamp designed according to the invention can be produced easily since its construction is relatively simple. Apart from the two sliding lattices and their connection to a low voltage source, it comprises no other electrical connecting means which would have to be passed to the individual lighting devices. Therefore, the optical impression of this lamp is not impaired by any cables passing along the outside of the lattice structure. Due to the fact that two parallel lattices are used which are made of electrically conductive material, the support structure itself of the lamp may be used, at the same time, as its electrical conductor to feed the illuminating means with current. This does not present any risk to the user of the lamp since the lattices are connected only to a low voltage source. The sliding lattices which extend in parallel are arranged in such a way that their joints are positioned opposite each other and may be used as connecting points for illuminating means. It is provided that those joints which are intended to receive the illuminating means are equipped with tubular incandescent bulb terminals and interconnected by tubular incandescent bulbs. But it is also possible to replace the tubular incandescent bulbs by any other similar lighting means.

The lattices preferably are made of electrically conductive metal. Use of this inexpensive material permits further lowering of the manufacturing cost.

In an advantageous further development of the invention those opposed joints not interconnected by small tubular incandescent bulbs are connected to each other by electrically insulating spacers. That results in much greater stability of an electrical concertina-type lamp according to the invention, originating from the plane of the sliding lattices. At the same time, any undue stressing of the small tubular incandescent bulbs caused by possible lateral excursions of the lattices as they are extended or pushed together is greatly reduced.

In another advantageous modification of the invention a row of joints which are disposed behind one another in the direction of extension of the sliding lattice each are connected to the respective opposite joints by small tubular incandescent bulbs. In this manner the length of an illuminated surface becomes readily adaptable by pushing and pulling the sliding lattices to adjust them to varying conditions, such as the length of an extensible table.

It is especially preferred to connect a row of joints which are located at the outside in the plane of the sliding lattices by small tubular incandescent bulbs to the respective opposite joints. This modification provides optimum illumination by means of a concertina-type lamp according to the invention as it is free of any disturbance.

According to another favorable modification of the invention, the electrical concertina-type lamp is connected to a 12 volt power source. This makes it possible to use common 12 volt lighting means, such as 12 V halogen bulbs, as the illuminating means for the electrical concertina-type lamp according to the invention.

It is advantageous if the sliding lattices form part of the support skeleton of the concertina-type lamp. This modification permits exceptionally simple design and inexpensive production of the concertina-type lamp.

BRIEF DESCRIPTION OF THE DRAWING

The invention will be described further, by way of example, with reference to the accompanying drawings, in which.

DESCRIPTION OF THE PREFERRED EMBODIMENTS

Figure 1:
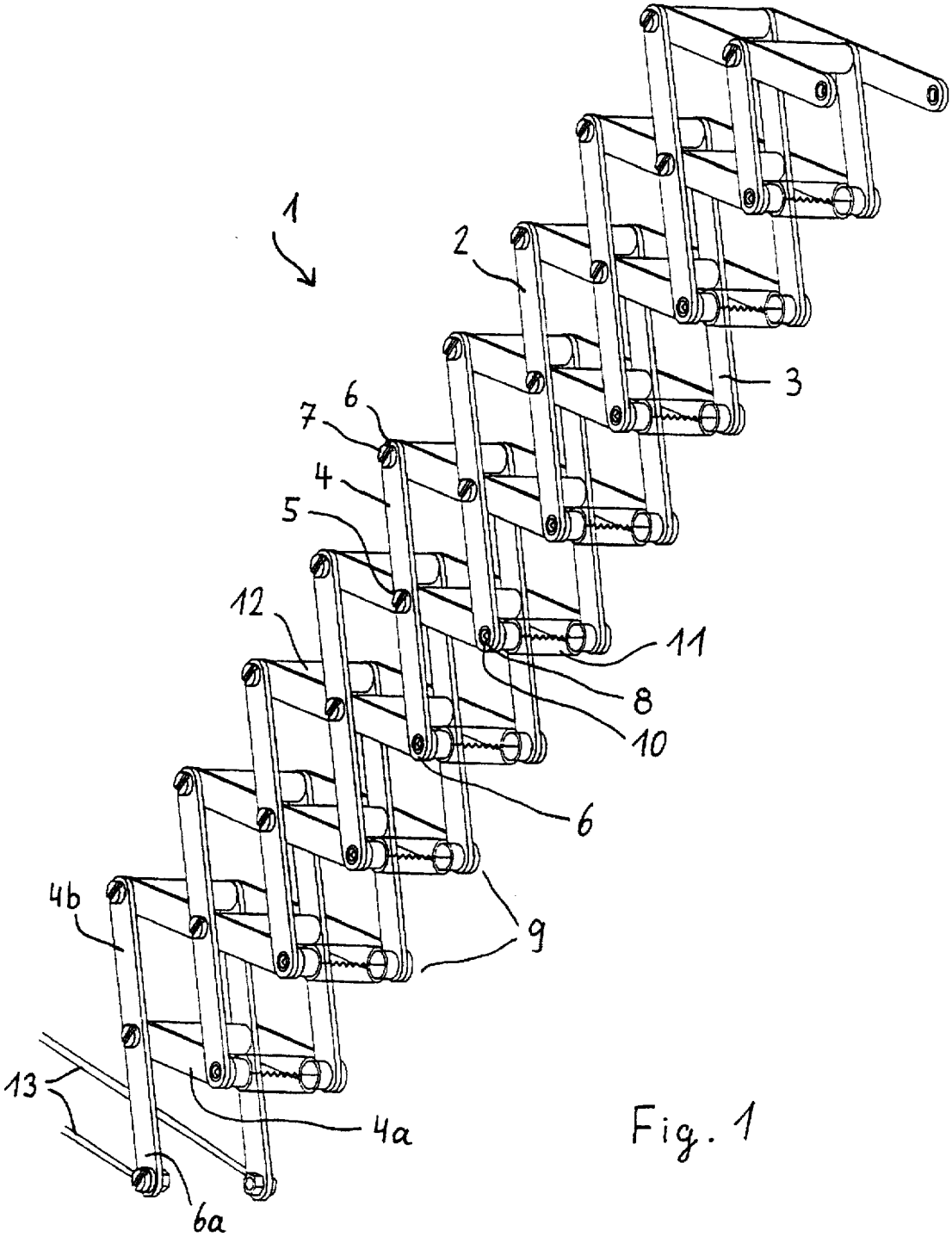
FIG. 1 is a perspective view of an electrical concertina-type lamp according to the invention and FIG. 2 is a side elevation of the electrical concertina- type lamp shown in FIG. 1, suspended horizontally as a lighting fixture.

The electrical concertina-type lamp 1 illustrated in FIG. 1 comprises two identical sliding lattices 2, 3 which extend parallel to each other and are made of electrically conductive metal. The sliding lattices 2, 3 each consist of individual flat, planar bars 4 which are connected at both ends 6 in articulated fashion to the respective adjacent bars 4. Each sliding lattice 2, 3 includes a short bar **4*a* at either end for articulated connection of the respective middle 5 of the last or end bar 4*b* to one end of the penultimate bar 4 which has the same orientation. In this manner one end 6*a* of the end bar 4*b*** remains free. The bars 4, 4a, 4b are provided with bores to form the joints 5, 6, and the bores of those bars which are to be connected to each other are located on top of each other for fastening means, such as screws 7 or rivets 8 to be inserted so as to make the joint connections. As the interconnected bars 4, 4a, 4b contact each other, electrical conductivity is guaranteed. The sliding lattices 2, 3 are arranged such that their corresponding joints 5, 6 are located opposite each other.

A continuous row 9 of joints 6 lieing one behind the other in the direction of extension of the sliding lattice 2, 3 and at the outside in the plane of the sliding lattice are equipped with tubular bulb terminals 10, embodied by hollow rivets 8, each of which receives one end of a small tubular incandescent bulb 11. These opposed joints of the sliding lattices 2, 3 thus are interconnected by small tubular incandescent bulbs 11. The other mutually opposed joints 5, 6 of the sliding lattices are connected to each other by electrically insulating spacers 12, whereby the stability in space of the concertina-type lamp 1 is safeguarded. The spacers 12 between the sliding lattices 2, 3 are retained by screws 7 which extend through the bores in the bars 4, 4a, 4b and consequently, at the same time, form the articulated connections at these joints 5, 6.

At one end of the sliding lattices 2, 3 the respective free end 6a of the end bars 4b is connected by electrical connecting means 13 to a low voltage source (not shown). The sliding lattices 2, 3 consequently serve not only as a telescopic support structure of an electrical lighting fixture but also as its electrical conductors by which the illuminating means 11 receive their power supply.

Figure 2:
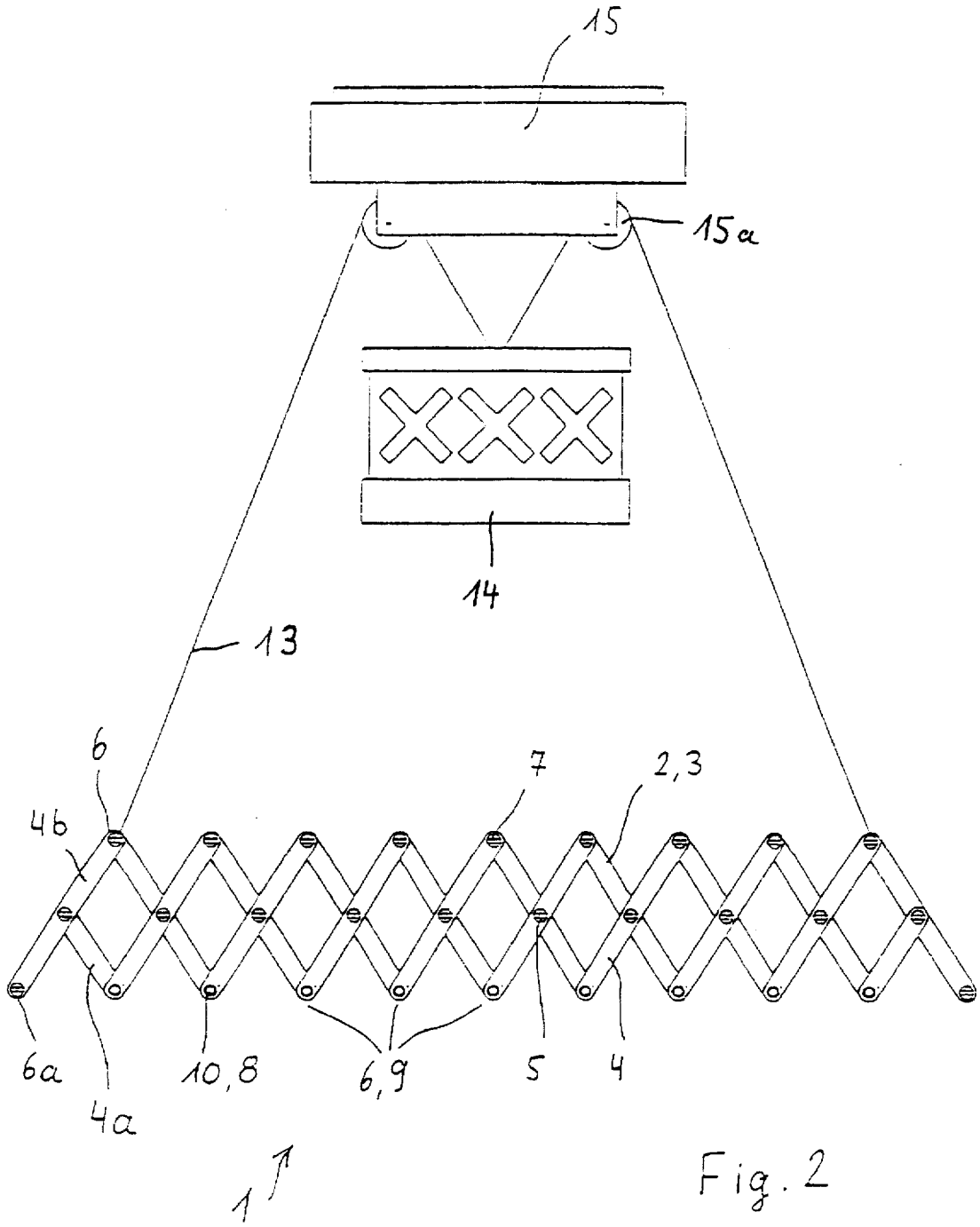

FIG. 2 depicts the concertina-type lamp 1 shown in FIG. 1 in the form of a horizontally oriented suspended lighting fixture. It is suspended from a fastening device 15 (shown only diagrammatically) so as to be adjustable in height by means of cables 13 which engage the upper joints 6 of the end bars 4b of the sliding lattices 2, 3. On the whole, the concertina-type lamp 1 thus is suspended from four cables 13, i.e. it is suspended at both ends of each sliding lattice 2, 3. In the side elevation of FIG. 2 only one of the sliding lattices which are located one behind the other is to be seen with its two cables. The fastening device 15 comprises four rolls 15a which are arranged spaced from one another in the plane of the drawing and vertically to the same. The two cables 13 of a sliding lattice 2, 3 first extend upwardly to a respective one of two rolls 15a which lie opposite each other in parallel with the plane of the drawing, then turn around in downward direction towards a counterweight 14 positioned between the fastening device 15 and the sliding lattices 2, 3. Vertical shifting of this counterweight 14 adjusts the level of the concertina-type lamp 1.

The rolls 15a are made of electrically conductive material and are electrically insulated with respect to one another. A low voltage source (not shown) embodied by a transformer is received in the fastening device 15. Two rolls 15a which lie opposite each other in parallel with the plane of the drawing are connected to the one pole of the low voltage source, and the other two rolls 15a are connected to the other pole of the low voltage source. The four cables 13 which pass around the rolls 15a are bare and thus function not only as fastening means of the concertina-type lamp 1 but, by contacting the rolls 15a, also as the electrical connectors.

The tubular bulb terminals 10 formed to receive the small tubular incandescent bulbs 11 are to be seen in the lower row of joints 6, 9 of the sliding lattices. In the embodiment illustrated here, electrically insulating spacers 12 are mounted in the lower row of joints 6, 9 between the joints 6a at the ends of the sliding lattices 2, 3 and also between the joints 5, 6 of the central and upper rows. This warrants dimensional stability based on the plane of the drawing. The luminosity of the small tubular incandescent bulbs 11 can be concentrated in a small area by pushing together the sliding lattices 2, 3. On the other hand, the light emanating from the small tubular incandescent bulbs 11 will be distributed uniformly across a great, elongated area if the sliding lattices 2, 3 are extended. It is conceivable as well that only some of the mutually opposed joints 5, 6 of a row are interconnected by small tubular incandescent bulbs 11 or that the illuminating means are arranged not only in the lowermost row of joints 6 but also in the central or upper rows of joints 5, 6 or in each row of joints 5, 6 or any random distribution across the various rows. Leaving aside practical considerations, there are no limitations in this respect.

Moreover, the sliding lattices also may be supported in vertical position or at any other desirable angle. Besides suspending the lighting fixture, any other suitable means of fastening, e.g. by supports, may be chosen. It is likewise conceivable to combine two or more concertina-type lamps in a series arrangement.

What is claimed is:

1. An electrical concertina-type lamp, comprising two identical concertina-type sliding lattices (2,3) which extend parallel to each other and are made of electrically conductive material, said lattices each including a plurality of pivotal (5, 6) joints which are disposed in at least one row extending along the length of the lattices and so as to permit extension and retraction of its length, with the joints of the two lattices being respectively aligned to define a plurality of pairs of opposed joints, with said lattices being connected to respective ones of the poles of a low voltage power source, and at least one of said pairs of opposed joints being provided with tubular bulb terminals (10) and interconnected by at least one small tubular incandescent bulb (11).

2. The lamp as claimed in claim 1, wherein the sliding lattices (2, 3) are made of electrically conductive metal.

3. The lamp as claimed in claim 1, wherein at least a plurality of the pairs of the opposed joints (5, 6) other than said at least one of the pairs of opposed joints are connected to each other by electrically insulating spacers (12).

4. The lamp as claimed in claim 1, wherein said at least one of said pairs of opposed joints comprises a plurality of said pairs of opposed joints which extend along said one row of pivotal joints.

5. The lamp as claimed in claim 4, wherein said two lattices define an outside edge which extends between the two lattices and along the length thereof, and wherein said one row of pivotal joints is disposed along said outside edge.

6. The lamp as claimed in claim 1, wherein said power source is a 12 volt power source.

7. An electrical concertina-type lamp, comprising two identical sliding lattices which extend parallel to each other and are made of an electrically conductive material, electrical connecting means for connecting each of said lattices to a pole of an electrical power source, and each of said lattices comprising a plurality of bars which are joined to each other in a crossing relationship at a plurality of pivotal joints so as to permit extension and retraction of its length and the conduction of electrical current along its length, with the joints of the two lattices being respectively aligned to define a plurality of pairs of opposed joints, and with at least a plurality of said pairs of opposed joints being interconnected by an electrical light fixture so as to be illuminated upon the electrical connecting means connecting the lattices to the electrical power source.

8. The lamp as claimed in claim 7 wherein at least some of said pairs of opposed joints are not interconnected by an electrical fixture and are interconnected by electrically insulating spacers.

9. The lamp as claimed in claim 8 wherein said plurality of pairs of opposed joints which are interconnected by an electrical light fixture are disposed along a row extending along the length of the lattices.

10. The lamp as claimed in claim 9 wherein said two lattices define an outside edge which extends between the two lattices and along the length thereof, and wherein said row of pivotal joints is disposed along said outside edge.

* * * * *